US006105256A

United States Patent [19]

Budrow

[11] Patent Number: 6,105,256

[45] Date of Patent: Aug. 22, 2000

[54] CUTTING SHEAR

[75] Inventor: William B. Budrow, Long Beach, Calif.

[73] Assignee: Allied International, Inc., Sylmar, Calif.

[21] Appl. No.: 09/371,029

[22] Filed: Aug. 10, 1999

[51] Int. Cl.[7] ..... B26B 17/00

[52] U.S. Cl. ..... 30/186; 30/176

[58] Field of Search ..... 30/129, 176–179, 30/186, 233, 262

[56] References Cited

U.S. PATENT DOCUMENTS 771,687 10/1904 Steventon ..... 30/233

3,772,783 11/1973 Averitt ..... 30/186

5,613,300 3/1997 Schmidt ..... 30/125 X

*Primary Examiner*—Douglas D. Watts

*Attorney, Agent, or Firm*—Jack C. Munro

[57] ABSTRACT

A cutting shear which is formed of a pair of members pivotally mounted in a scissors arrangement. Each member has a jaw member and a handle member, and within one of the handle members is mounted an internal chamber which is closeable by a removable cap located at the outermost end of this handle member. A bail is mounted on the cap and is to be connectable with the opposite handle member to lock the cutting shear in a closed position. One of the jaw members includes a cutting blade with the cutting blade having a cutting edge which is mounted non-parallel to its jaw member.

2 Claims, 2 Drawing Sheets

CUTTING SHEAR

BACKGROUND OF THE INVENTION

1. Field of the Invention

The field of this invention relates to cutting shears that are typically used to cut objects such as cardboard, carpeting, vinyl tile, textile rope, garden hose, tubing, electrical wire, etc.

2. Description of the Prior Art

Cutting shears have long been known. A typical cutting shear comprises a pair of members which are connected together in a scissors-like arrangement each having a jaw member and a handle member. Mounted within one of the jaw members is a cutting blade, and upon a squeezing action being applied between the pair of handle members, the cutting blade is to be forcibly moved in conjunction with an anvil jaw member thereby performing a cutting operation upon an object which would be located between the cutting edge and the anvil jaw member.

In the past, very little has been done to enhance the improvement of the cutting action of such a cutting shear. It is common for the cutting blades to break or become dull during operation. There is normally not included, within a cutting shear, a compartment for the storage of replaceable cutting blades so such a replaceable blade can be extracted and replaced for a cutting blade that is broken or has become dull.

SUMMARY OF THE INVENTION

The cutting shear of the present invention is constructed of a blade jaw member, which is integrally connected to a first handle member, and an anvil jaw member which is integrally connected to a second handle member. The bridge areas between each jaw member and each handle member are connected together by means of a pivot pin so that the blade jaw member can be moved toward and away from the anvil jaw member by a squeezing action applied between the handle members. Within the blade jaw member there is mounted a cutting blade with the cutting edge to come into contact with the anvil jaw member. On the anvil jaw member is a measurement scale for the purpose of making measurements of an object to determine at what position a cut is to be made by the cutting shear. The cutting blade is mounted so that the cutting edge is located at a non-parallel position relative to the lineal facing surface of the blade jaw member. As the cutting shear is moved from the open position to the closed position, the portion of the cutting blade nearest the bridge areas first contacts the anvil jaw member and then progressively contacts the anvil jaw member until there is full contact between the cutting blade and the anvil jaw member when in the closed position. The second handle member includes an internal chamber within which is adapted to be stored exterior objects, such as replaceable cutting blades. The second handle member includes a narrowed extension which is closeable by a tightly fitting cap with this cap being removably engaged with the second handle member. Also connecting with the cap is a bail which is to be engageable with the first handle member so as to lock the cutting shear in the closed position. The bail engages with slots formed in the narrowed extension facilitating securement of the cap on the narrowed extension.

DETAILED DESCRIPTION OF THE PREFERRED EMBODIMENT

Figure 1:
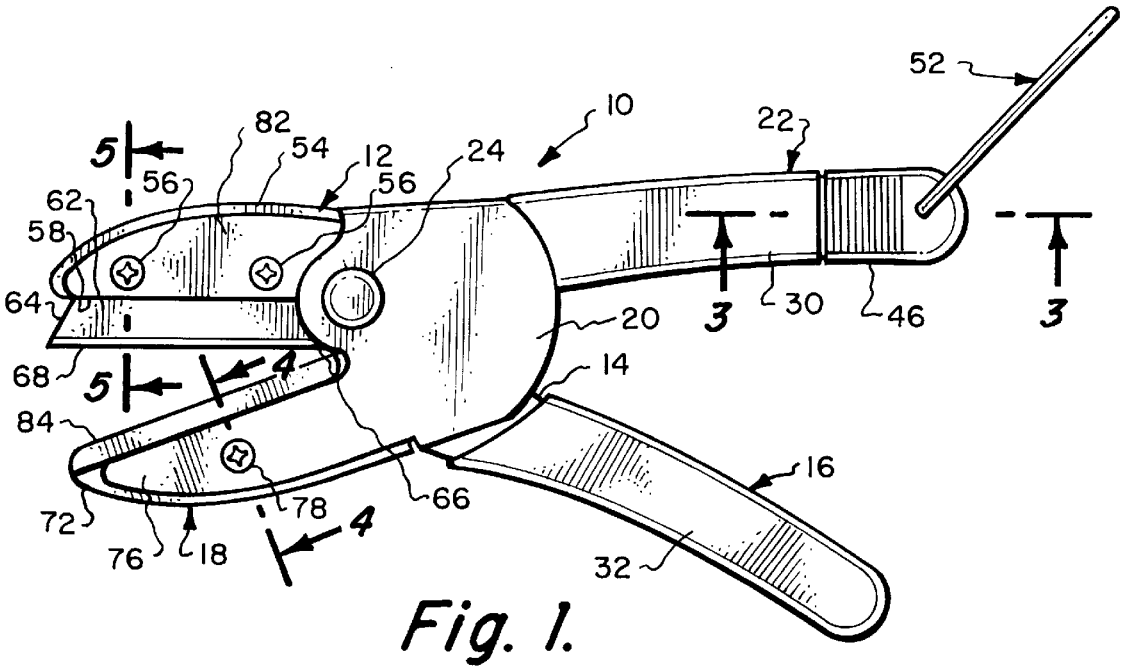
FIG. 1 is a side elevational view of the cutting shear of the present invention showing the cutting shear in the open position.

Referring particularly to the drawings, there is shown the cutting shear 10 of this invention. The cutting shear 10 is composed of a blade jaw member 12 which is integrally connected through a bridge section 14 with a first handle member 16. The cutting shear 10 also includes an anvil jaw member 18 which is integrally connected through a bridge section 20 to a second handle member 22. A pivot pin 24 secures together the bridge sections 14 and 20 and mounts the jaw members and handle members 16 and 22 in a scissor-like arrangement. The handle members 16 and 22 are to be graspable by a human and moved from the open position, shown in FIG. 1, to the closed position, shown in FIG. 2. The movement of the handle members 16 and 22 is depicted by arrows 26 and 28.

Covering the handle member 22 is a soft rubber-like covering 30 so when the human grasps the handle member 22 it is comfortable to the hand. A similar such covering 32 is mounted on the handle member 16. The covering 30 is mounted directly onto a metallic inner portion 34 of the handle member 22. This inner portion 34 has an outermost section which is formed into a narrowed extension 36. This narrowed extension 36 assumes a U-shaped configuration in cross-section with the legs of the U-shape being located parallel to each other and the apex being located perpendicular to each of the legs. Within one of the legs is located an open-ended slot 38 and the opposite leg has an openended slot 40. The slots 38 and 40 are in transverse alignment. Internally of the inner portion 34 is located an internal chamber 42. Within this internal chamber 42 is to be stored articles such as a series of replaceable blades 44.

Replaceably mounted onto the narrowed extension 36 is a plastic cap 46. The cap 46 is to completely cover the narrowed extension 36 and is to be located thereon in a snug fitting manner. With the cap 46 on the narrowed extension 36, the ends 48 and 50 of a bail 52 engage respectively with the slots 38 and 40. This engagement of the ends 48 and 50 with the slots 38 and 40 facilitates securement of the cap 48 onto the narrowed extension 36. The bail 52 can be moved from an unattached position, shown in FIG. 1, to an attached position shown in FIG. 2 with the bail 52 being located around the first handle member 16 thereby locking the cutting shear 10 in the closed position, as shown in FIG. 2.

Figure 2:
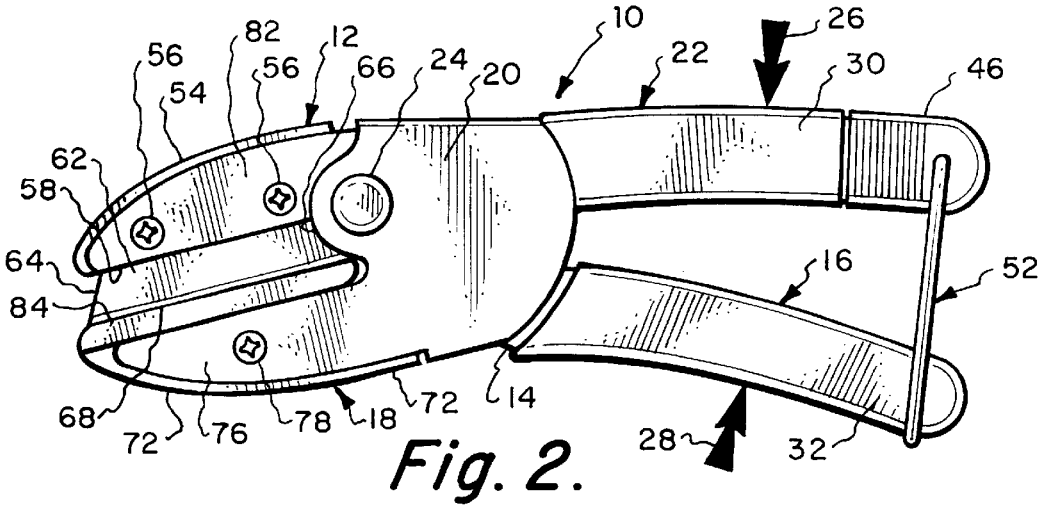
FIG. 2 is a side elevational view of the cutting shear of the present invention similar to what was shown in FIG. 1 but with the cutting shear in the closed position.
Figure 3:
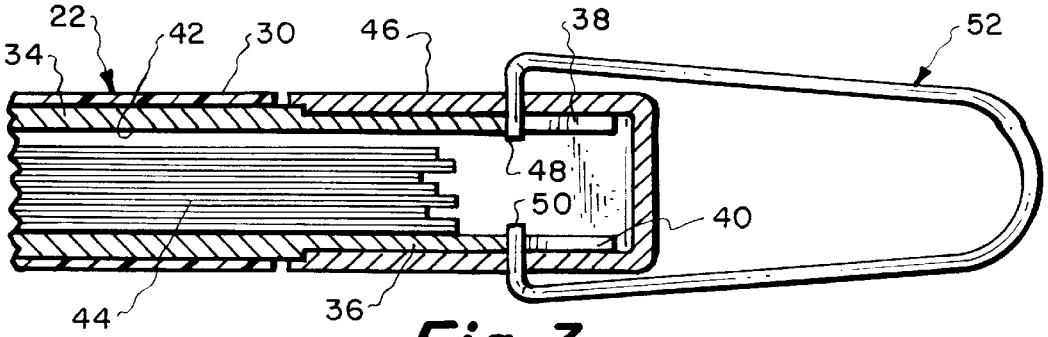
FIG. 3 is a cross-sectional view through one of the handle members of the cutting shear of the present invention taken along line 3—3 of FIG. 1 showing in detail the internal chamber located within that handle member.
Figure 4:
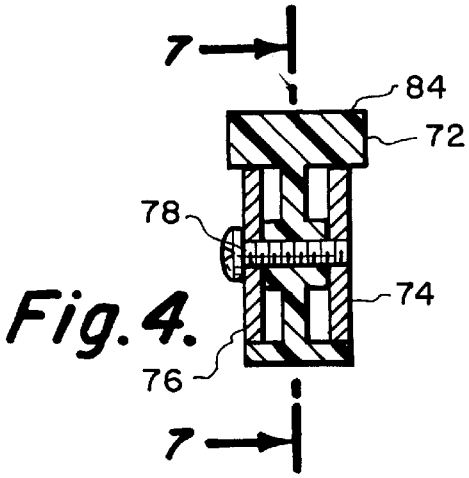
FIG. 4 is a transverse cross-sectional view through one of the jaw members of the cutting shear of the present invention taken along line 4—4 of FIG. 1.
Figure 5:
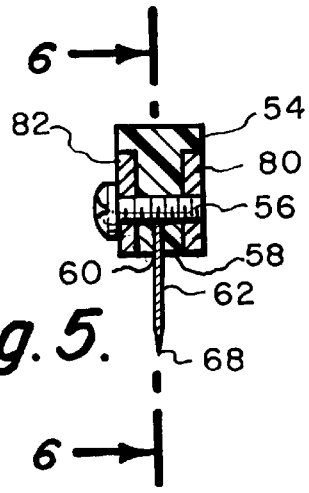
FIG. 5 is a cross-sectional view through the blade jaw member that has the cutting blade mounted thereon taken along line 5—5 of FIG. 1.

It is to be understood that upon removal of the bail 52 from handle member 16 that there is a spring, which is not shown, and is associated with the pivot pin 24, that immediately moves the cutting shear 10 to the open position shown in FIG. 1.

Figure 6:
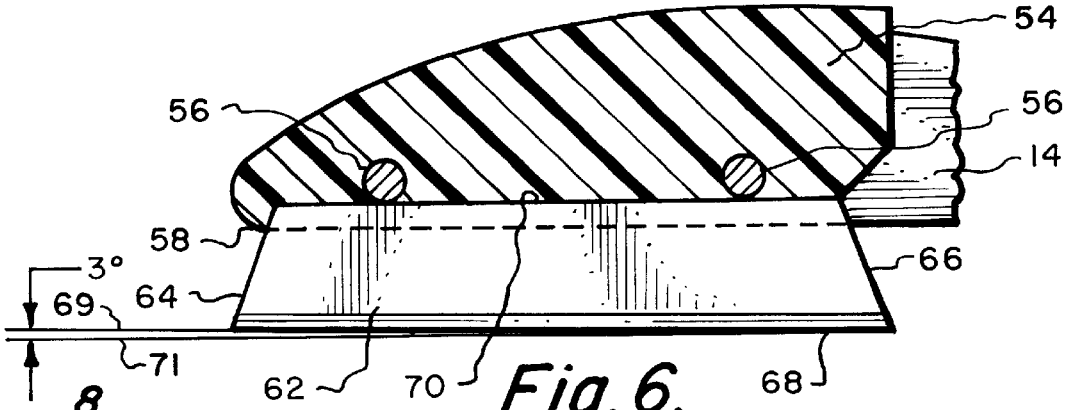
FIG. 6 is a longitudinal view of the blade jaw member taken along line 6—6 of FIG. 5.
Figure 7:
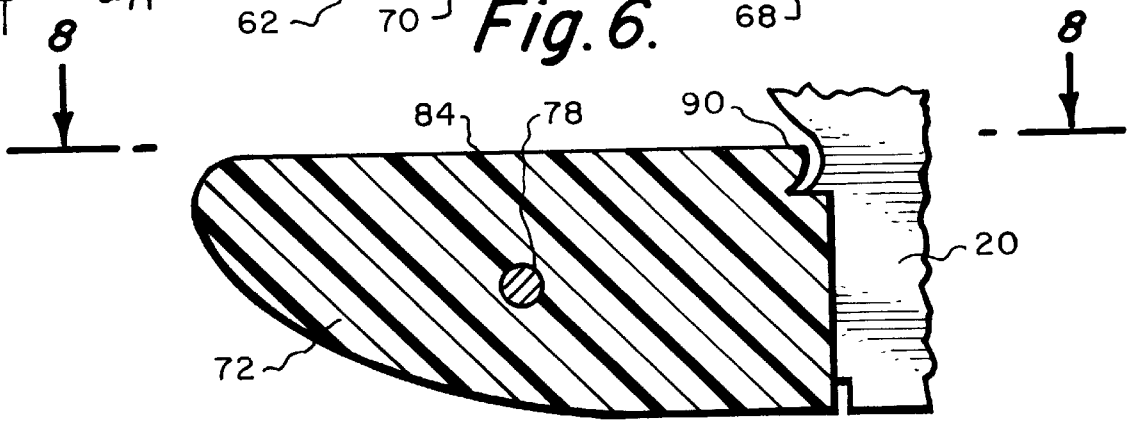
FIG. 7 is a longitudinal cross-sectional view of the anvil jaw member taken along line 7—7 of FIG. 4.
Figure 8:
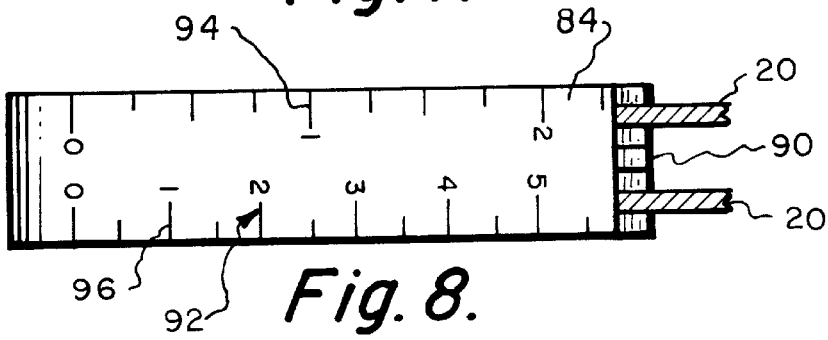
FIG. 8 is a top plan view of the lineal surface of the anvil jaw member of FIG. 7 taken along line 8—8 showing the lineal surface having a measurement scale.

The blade jaw member 12 includes a first plastic insert 54 which is fixedly mounted onto bifurcated jaw plates 80 and 82 in position on blade jaw member 12 by means of screw fasteners 56. The first plastic insert 54 has a first lineal surface 58 within which is located a longitudinal slot 60. When fasteners 56 are loosened, within the longitudinal slot 60 is to be mounted a metallic cutting blade 62 which has a fore end 64 and an aft end 66. In between the fore end 64 and the aft end 66 is formed a cutting edge 68. It is to be noted that the cutting edge 68 is lineal and is located in plane 69. The metallic cutting blade 62 also includes a back edge 70 with this back edge 70 to be located within the slot 60, and the back edge 70 is to be positioned directly against the screws 56. The position of the screws 56 is such that it will automatically position the cutting blade 62 so that the cutting edge 68 is offset or located non-parallel to the first lineal surface 58. The amount of offset is selected to be about three degrees shown in FIG. 6 between plane 69 and line 71 which is parallel to first lineal surface 58. Actually, as can be readily observed from FIGS. 1 and 6 of the drawings, the fore end 64 extends a shorter distance from the first lineal surface 58 than does the aft end 66. When the fasteners 56 are tightened, a squeezing, securing action is applied to the back edge 70 of the cutting blade 62 thereby securing the cutting blade in a fixed position within the blade jaw member 12.

The anvil jaw member 18 includes a plastic insert 72 which is mounted between second bifurcated jaw plates 74 and 76. The plastic insert 72 is secured in place by means of screw 78. The plastic insert 72 has a lineal surface 84. When the cutting shear 10 is in the closed position, as shown in FIG. 2, the cutting edge 68 is to be located flush against the lineal surface 84. As the cutting shear 10 is closed, a progressively cutting action is obtained of the cutting edge 68 against the lineal surface 84 similar to how a conventional knife cuts an object. When bringing of jaw members 12 and 18 together, the aft portion of the cutting blade 62 will be under compression as such is being pressed toward anvil jaw member 18. This is the preferred design which results in the best overall cutting performance throughout the length of the cutting block 62. During the cutting action, complete cutting of the exterior object will be obtained.

Inscribed, or otherwise formed on the lineal surface 84, is a measurement scale 92. The measurement scale 92 can include inch indicia 94 and centimeter indicia 96. It is intended that the measurement scale 92 can be used by the user to measure certain distance on a particular exterior object in which a cut is to be made prior to the cutting shear then being turned ninety degrees and used to perform the particular desired cut.

What is claimed is:

1. A cutting shear comprising:

a blade jaw member being pivotally mounted by a pivot pin to an anvil law member;

a first handle member being integral to said blade jaw member;

a second handle member being integral to said anvil jaw member;

said blade jaw member being located in juxtaposition with said anvil jaw member, said first handle member being located in juxtaposition with said second handle member, upon a manual squeezing movement being applied between said first and second handle members said blade member being movable from an open position with a space located between said blade jaw member and said anvil jaw member to a closed position with said blade jaw member located directly adjacent said anvil jaw member;

a cutting blade being mounted on said blade jaw member, said blade jaw member having a first lineal surface facing said anvil jaw member, said cutting blade having a fore end and an aft end with a sharpened edge located there between, said sharpened edge being located non-parallel to said first lineal surface with said sharpened edge of said aft end being located further from said first lineal surface than said sharpened edge at said fore end, said anvil jaw member having a second lineal surface facing said first lineal surface of said blade jaw member, with said cutting shear in said open position said cutting edge being located non-parallel to said second lineal surface with said fore end protruding a greater distance from said second lineal surface than said aft end, with said cutting shear in said closed position said cutting edge abuts said second lineal surface and is substantially parallel to said second lineal surface; and said second lineal surface having a measurement scale for making of quick measurements of an object to determine at what position a cut is to be made by said cutting shear.

2. A cutting shear comprising:

a blade jaw member being pivotally mounted by a pivot pin to an anvil jaw member;

a first handle member being integral to said blade jaw member;

a second handle member being integral to said anvil jaw member;

said blade jaw member being located in juxtaposition with said anvil jaw member, said first handle member being located in juxtaposition with said second handle member, upon a manual squeezing movement being applied between said first and second handle members said blade member being movable from an open position with a space located between said blade jaw member and said anvil jaw member to a closed position with said blade jaw member located directly adjacent said anvil jaw member;

a cutting blade being mounted on said blade jaw member, said blade jaw member having a first lineal surface facing said anvil jaw member, said cutting blade having a fore end and an aft end with a sharpened edge located there between, said sharpened edge being located non-parallel to said first lineal surface with said sharpened edge of said aft end being located further from said first lineal surface than said sharpened edge at said fore end, said anvil jaw member having a second lineal surface facing said first lineal surface of said blade jaw member, with said cutting shear in said open position said cutting edge being located non-parallel to said second lineal surface with said fore end protruding a greater distance from said second lineal surface than said aft end, with said cutting shear in said closed position said cutting edge abuts said second lineal surface and is substantially parallel to said second lineal surface;

said second handle member having an internal chamber adapted to contain extra Darts such as replaceable cutting blades, said first handle member terminating at an outermost end, said outermost end having a narrowed extension, a cap removably mounted on said narrowed extension; and said cap having a bail, said narrowed extension having slot means, said bail to lockingly engage with said slot means when said cap is mounted on said narrowed extension facilitating securement of said cap on said narrowed extension, said bail protruding from said cap and capable of engaging with said second handle member thereby locking said cutting shear in said closed position.

* * * * *